United States Patent [19]

Norris et al.

[11] 4,112,561

[45] Sep. 12, 1978

[54] APPARATUS FOR MANUFACTURING FILAMENTS OF VARYING DENIER AND ACTUATING MEANS THEREFOR

[75] Inventors: Alan H. Norris; Phillip W. Chambley, both of Rome, Ga.

[73] Assignee: Champion International Corporation, Stamford, Conn.

[21] Appl. No.: 771,425

[22] Filed: Feb. 24, 1977

[51] Int. Cl.[2] ..... D02J 1/22

[52] U.S. Cl. ..... 28/243; 57/55.5; 57/157 S

[58] Field of Search ..... 57/38.3, 55.5, 91, 157 S; 28/71.3, 72.17, 243; 242/147 M, 150 M; 425/76; 264/167, 290 R

[56] References Cited

U.S. PATENT DOCUMENTS

| | | | |
|---|---|---|---|
| 2,278,888 | 4/1942 | Lewis | 57/55.5 X |
| 2,847,703 | 8/1958 | Schrenk et al. | 57/91 |
| 2,907,535 | 10/1959 | Mindheim et al. | 242/150 M |
| 2,976,105 | 3/1961 | Rose et al. | 57/38.3 |
| 3,100,091 | 8/1963 | Mindheim et al. | 242/150 M |

*Primary Examiner*—Richard C. Queisser
*Assistant Examiner*—Charles Gorenstein
*Attorney, Agent, or Firm*—Evelyn M. Sommer

[57] ABSTRACT

An apparatus for manufacturing filaments of varying denier includes electrically activated tension means disposed between a feed roller and a draw roller for engaging the filament and producing a variable tension thereon when activated. A circuit arrangement for randomly activating the electrically activated tension means includes a thermally activated switch.

8 Claims, 8 Drawing Figures

APPARATUS FOR MANUFACTURING FILAMENTS OF VARYING DENIER AND ACTUATING MEANS THEREFOR

BACKGROUND OF THE INVENTION

The present invention relates to manufacturing yarn filaments of varying denier, and more particularly, to an apparatus for manufacturing filaments exhibiting random variations in the denier along the length thereof.

Prior art abounds with apparatuses which are designed to draw fibers (filaments) with their primary object being to obtain a product which has a constant denier (fixed diameter) along its entire length. Generally speaking, it has been undesirable to obtain variations in filament denier. These variations cause dye to be absorbed unevenly, thereby causing variations in the final cloth fabricated with this type of yarn filament. Typical examples of prior art directed to the drawing of filaments which attempt to maintain a constant denier are listed below:

| U.S. Patent No. | Invention Date | Inventor |
|---|---|---|
| 3,978,192 | August 31, 1976 | Sussman |
| 3,780,516 | December 25, 1973 | Kimbrell |
| 3,623,311 | November 30, 1971 | Berger, Jr. |
| 3,622,660 | November 23, 1971 | Ecker, et al. |
| 3,558,767 | January 26, 1971 | Gopez, Jr. |
| 2,289,232 | July 7, 1942 | Babcock |

The above patents describe apparatuses and methods which include the use of heat and/or different mechanical techniques which attempt to maintain a constant denier. However, we are aware of only two patents which attempt to create a variable denier yarn. The first of which is U.S. Pat. No. 3,561,045 issued to Heffernan of Feb. 9, 1971. The Heffernan patent uses a draw roll which is provided with a matte circumferential band and a mirror-finish circumferential band on a cylindrical surface cooperating with a separator roller which has a matte cylindrical surface. A cam is provided between the feed roll and the draw roll to deflect the filament between the two bands in a predetermined manner related to the shape of the cam. Thus, the denier of the filament is varied in a prescribed predetermined manner directly related to the shape of the deflecting cam.

U.S. Pat. No. 3,323,165 to Mottern, et al, issued June 6, 1967, relates to an apparatus providing variable denier yarn. This particular apparatus uses a radiant heat means intermittently applied proximate the filament being drawn at a point between the feed roll and the draw roll. A variation in the denier of the filament or yarn is directly related to the relative position of the radiant heat means to the filament being drawn and is cycled in a prescribed manner. The drawing technique is similar to that shown in the prior art.

A new development in the yarn industry, in recent years, has been the use of flat yarn raw material in the form of a partially oriented yarn. By definition, this means that the yarn has not been fully drawn or oriented. This yarn is completely drawn in a tandem continuous step as described in the prior art. However, as shown in the prior art, since the polymer does not stay in the fully drawn state for more than a few seconds before a new texturized configuration is further imposed upon it, the hydrogen bonds between the molecules have not been established in the fully drawn condition, and the yarn more easily assumes and retains the textured condition. Thus, the use of partially oriented yarns allows faster processing, more effective heat setting, less degradation and improved texture. The use of the partially oriented yarn in carpets requires that they be subjected to very critical quality control standards, since the pile yarn in the carpet is a visible warp yarn. Also, pile height causes a foreshortening of the yarn to the viewer. Using this type of yarn for carpets allows very critical visible comparison of the yarns and very small optical differences are clearly visible as lengthwise streaks in the carpet.

Thus, if we assemble sufficient partially oriented yarns to meet the total carpet denier requirements and then draw and texturize the yarn bundle, very critical quality control would be required to assure that yarns from different manufacturing equipment do not cause streaks in the carpet.

Normally, the undrawn yarn is passed between two sets of yarn gripping rollers, the second set running faster than the first. Thus, the yarn is extended (drawn) by the difference in roller speeds. This technique is known in the prior art and is generally acceptable for manufacturing yarn and filaments for general use. However, this invention relates to manufacturing yarns with varying draw ratios (denier) along the length of the yarn. A number of these yarns will then be assembled, and since each yarn will have different draw ratios along its length and other yarns will have the same variance, but not at exactly the same values, the composite yarn will have a wide spectrum of draw ratios. This will give a differential dye takeup in the polyester element and hence, the composite yarn will dye to a heather mixture of different depths. But more importantly, all yarns produced on different machinery will have a sufficiently wide spectrum so that small variations and draw ratios caused by variances in manufacturing spindles will fall inside the overall spectrum.

The present invention overcomes the shortcomings known in the prior art and discloses a mechanism which is less costly than those known and readily provides a variable draw (denier). The present invention utilizes electrically activated means (electromechanical) for providing tension in a random manner for obtaining variable denier yarn filaments. The tension applied to the filament is proportional to the voltage appearing on the tension applying apparatus. By varying several parameters, a multiplicity of draw ratios can be obtained.

SUMMARY OF THE INVENTION

An object of the present invention is to provide an apparatus for fabricating filaments exhibiting variations in denier along its length.

Another object of the present invention is to reduce the critical nature of manufacturing variable denier yarns to be used in carpeting.

A further object of the present invention is to provide electrically activated tension means for varying the denier of filaments in a random manner.

A still further object of the present invention is to provide actuating means for energizing the electrically actuated tension means.

Yet another object of the present invention is to provide a plurality of randomly activated actuating means to energize the tension means.

Another object of the present invention is to provide economical means for varying the denier of the filaments and enable filaments drawn on different machinery to fall within a given range of draw ratios thus forming a random pile in the finished product which is pleasing to the eye.

An apparatus for fabricating filaments exhibiting variations in denier along its length, according to the principles of the present invention comprises, means to propel a running filament from a feed roller to a draw roller, electrically activated tension means disposed between the feed roller and the draw roller engaging the filament for producing variable tension thereon, and actuating means coupled to the tension means for random energization thereof.

In order that the invention may be more fully understood it will now be described by way of example with reference to the accompanying drawing.

DESCRIPTION OF THE PREFERRED EMBODIMENT

Figure 1:
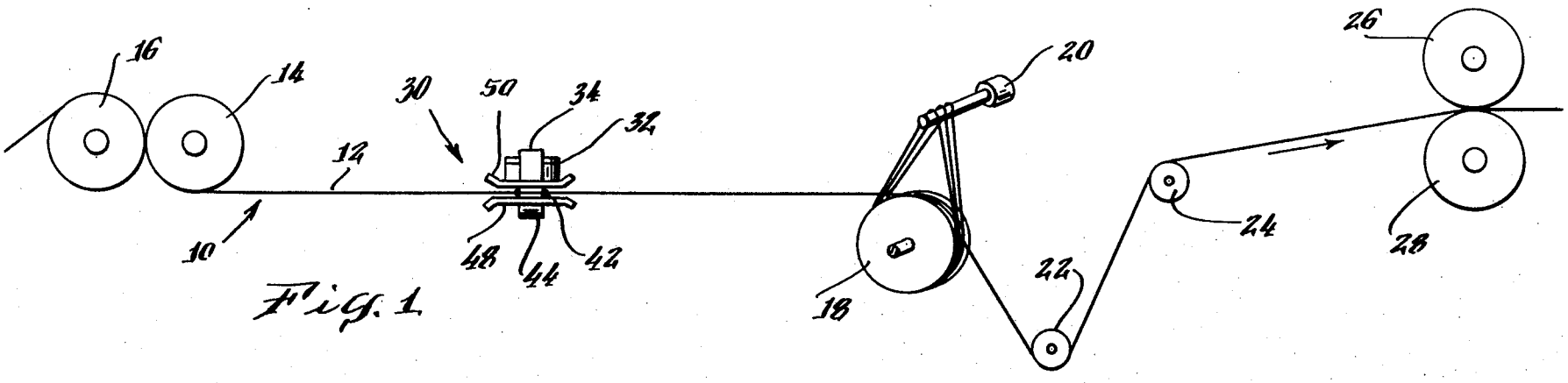
FIG. 1 is a pictorial representation of one portion of an apparatus for manufacturing filaments of varying denier according to the principles of the present invention.

Now referring to the figures and, more particularly, to FIG. 1 showing a pictorial representation, in simplified for, of a variable denier drawing apparatus 10 having means to propel a running length of filament (yarn) 12. The drawing apparatus 10 includes a feed roller 14 and its associated snubbing roller 16, a draw roller 18 with its cooperating separator roller 20, idler pulleys 22 and 24 guide the filament 12 to a pair of pull rollers 26 and 28, or alternatively, a take up bobbin not shown. In the prior art, as discussed before, the stretching of the yarn is normally caused by the draw roller 18 operating at a much higher speed than the feed roller 14 or it may be accomplished by providing the draw roller with a greater diameter and permitting it to operate at a greater speed than that of the feed roller.

Figure 2:
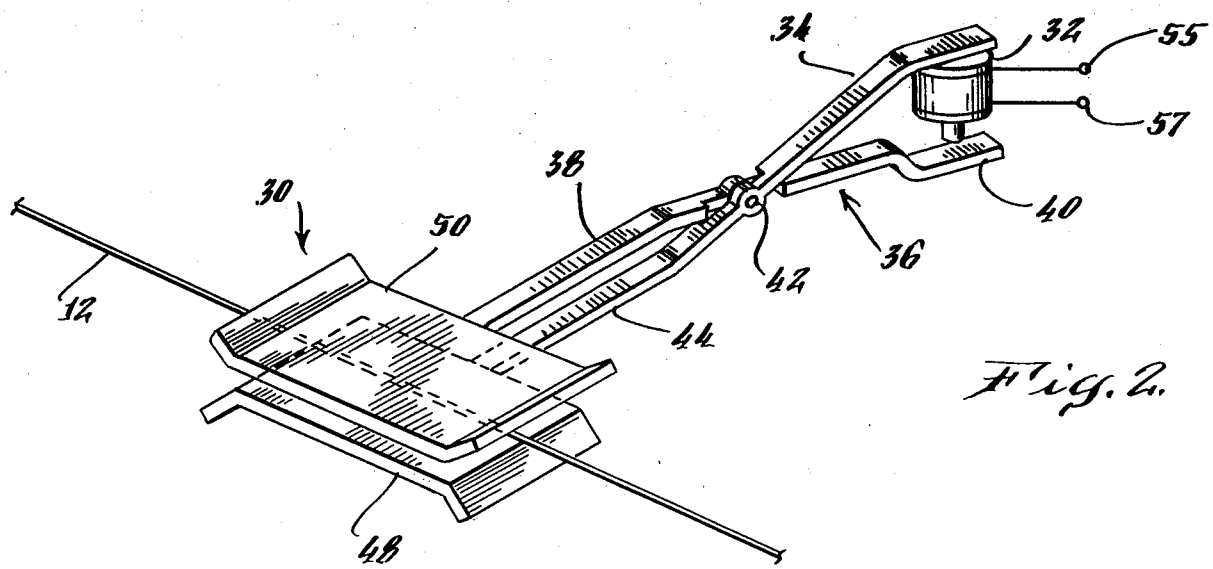
FIG. 2 is a pictorial representation of a preferred embodiment of an electrically activated means for providing variable tension to a filament.

In the preferred embodiment of the invention there is disposed between the feed roller 14 and the draw roller 18 an electrically activated tension means 30, which may be activated by conventional means, not shown, and may include a solenoid mechanism 32, adapted to be affixed on one arm 34 of a scissor mechanism 36, as shown in FIG. 2. The second arm 38 of scissor mechanism 36 has one end 40 thereof disposed in close proximity to the solenoid mechanism 32 and is adapted to cooperate with it. Arms 38 and 40 are pivoted in a conventional manner at pivot point 42. The opposite ends 44 and 46 of arms 34 and 38, respectively, are provided with tension (friction) plates 48 and 50, respectively. Tension plates 48 and 50 are in juxtaposition and are adapted to receive the filament 12 therebetween. In the deenergized or deactivated position of solenoid 32, the yarn 12 is permitted to freely pass between the tension plates 48 and 50. However, when the solenoid 32 is activated it causes tension plates 48 and 50 to come together applying pressure on the filament 12 thereby increasing the tension thereon. The amount of tension applied to the filament 12 is directly related to the voltage used to activate the solenoid coil 52, the voltage being provided across coil terminals 55 and 57.

Figure 3:
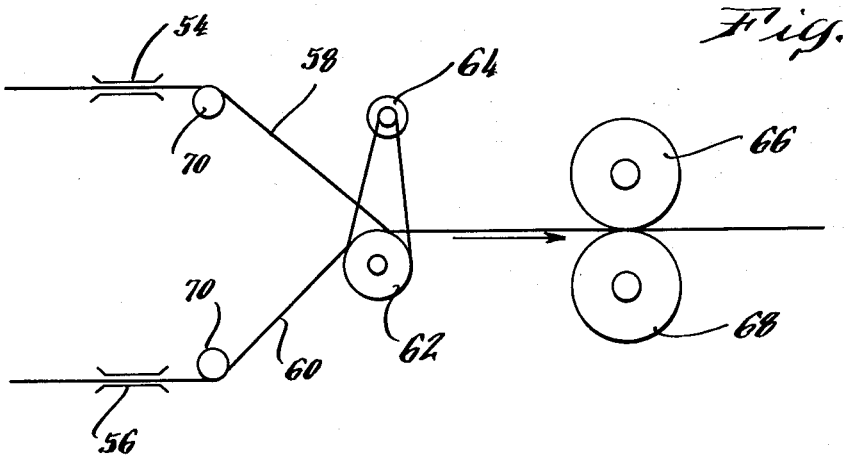
FIGS. 3 and 4 are pictorial representations showing the location of the electrically activated tension means which can provide different results with the same activating voltage.

Referring now to FIG. 3 which is a pictorial representation of a pair of tension means 54 and 56 both being similar to the tension means 30 and adapted to receive filaments 58 and 60, respectively, between their respective tension plates. The filaments are arranged to be drawn by a draw roller 62 and its cooperating separator roller 64 before entering the stuffer box pull rollers 66 and 68. Guide rollers 70 guides filaments 58 and 60 towards draw roller 62. The tension means 54 and 56 are shown equidistant from draw roller 62. However, if different voltages are applied to tension means at the same instant of time then it is obvious that different draw ratios of filaments 58 and 60 will be obtained.

Figure 4:
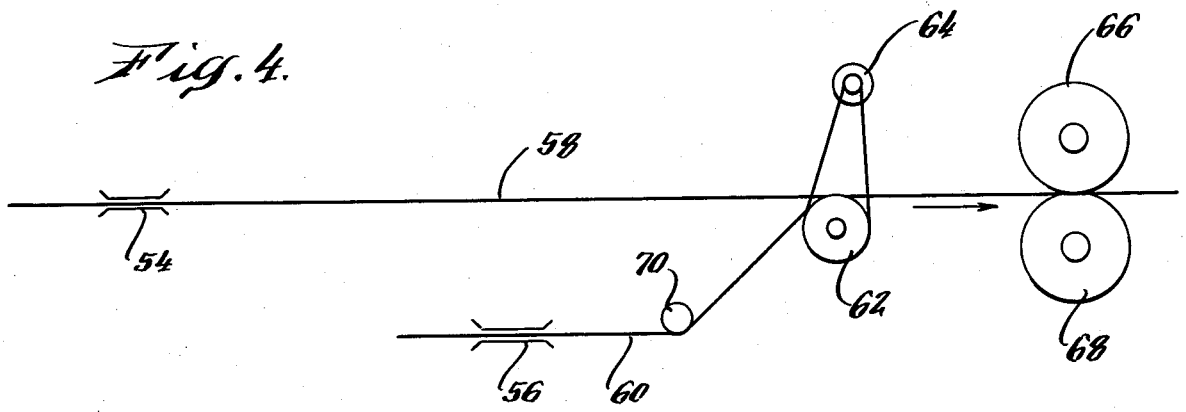

Referring now to FIG. 4 which shows an arrangement similar to FIG. 3 with the exception that the tension means 54 and 56 are spaced at different distances from the draw roller 62. Thus, it is obvious that further variations in draw ratios can be obtained since equal voltages applied to the tension means 54 and 56 will apply the same tension to the filaments 58 and 60, but since there is a greater amount of filament 58 exposed to tension, it can expand (increase in length) a greater amount introducing further variations in denier.

Figure 5:
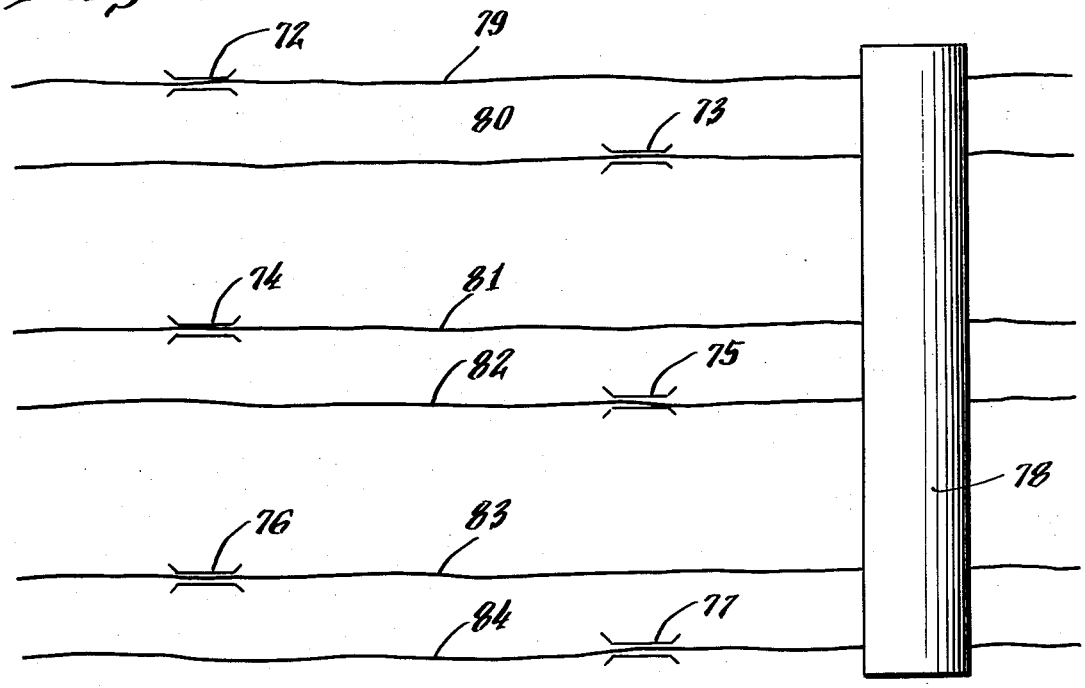
FIG. 5 is a pictorial representation showing the location of the tension devices for obtaining a plurality of denier variations with a device such as shown in FIG. 2.

Referring now to FIG. 5 which is a pictorial representation of a plurality of tension devices 72, 73, 74, 75, 76, and 77 each being similar to tension means 30 and disposed at varying distances from the draw roller 78 and each having filaments 79, 80, 81, 82, 83, and 84, respectively passing through their respective tension plates. Thus, it now becomes obvious that a plurality of draw ratios (denier) may be obtained in a simplified manner in accordance with the principles of the present invention.

Figure 6:
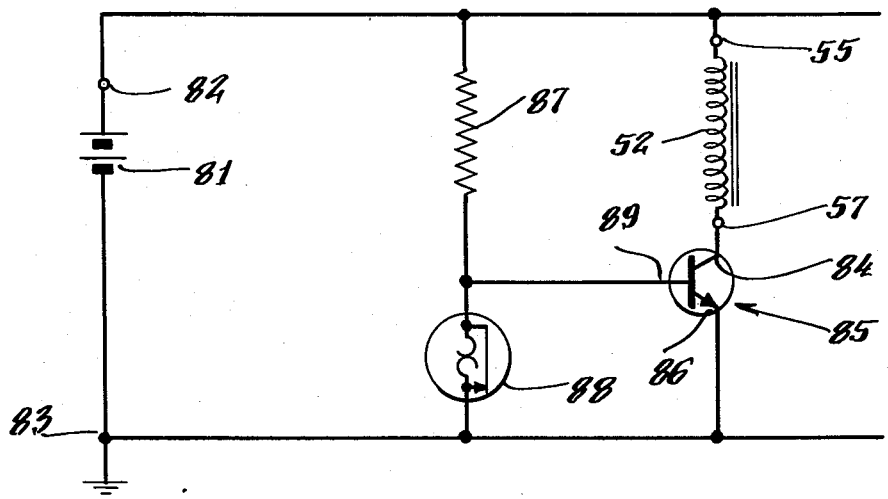
FIG. 6 is a schematic circuit diagram of an activating means capable of energizing the variable tension device.

FIG. 6 is a schematic circuit diagram of a preferred embodiment of an actuating means for randomly activating the tension means 30 disclosed hereinbefore. The coil 52 of the solenoid 32 is provided with terminals 55 and 57. One coil terminal 55 is connected to a source of DC voltage 81 at terminal 82. The DC voltage source 81 is provided with a reference ground terminal 83. The other coil terminal 57 is connected to the collector electrode 84 of transistor 85. The emitter electrode 86 of transistor 85 is coupled to the ground reference 83.

A resistor 87 is connected in series with a thermally activated switch (thermal switch) 88 across the source of DC voltage 81 at terminals 82 and 83. The base electrode 89 of transistor 85 is connected to the common connection of resistor 87 and thermal switch 88.

In operation, the thermal switch is normally closed thus shorting the base electrode 89 to the emitter electrode 86 of transistor 85 resulting in essentially no current flowing in the emitter-collector current path and therefore no current or voltage is provided to activate the tension coil 52. The thermal switch 88 heats up with the passage of time, because it is being supplied with current via resistor 87, and changes its state from normally closed to open. When switch 88 opens then the current flowing in resistor 87 flows into the base-emitter junction causing transistor 85 to saturate (conduct a large amount of current) in the collector-emitter junction. With transistor 85 saturated the full DC supply voltage 81 appears across tension coil 52 with maximum current flowing therethrough, thereby activating tension coil 52. By selecting the thermal switch 88 which trips (changes its state) at a different temperature for each circuit used and/or by using different values of resistance or resistor 87 the time at which switch 88 changes states can be altered. Combining a plurality of the circuit arrangements as shown in FIG. 6 with the physical location of the tension devices as shown in FIG. 5 will yield yarn filaments with randomly variable denier.

Figure 7:
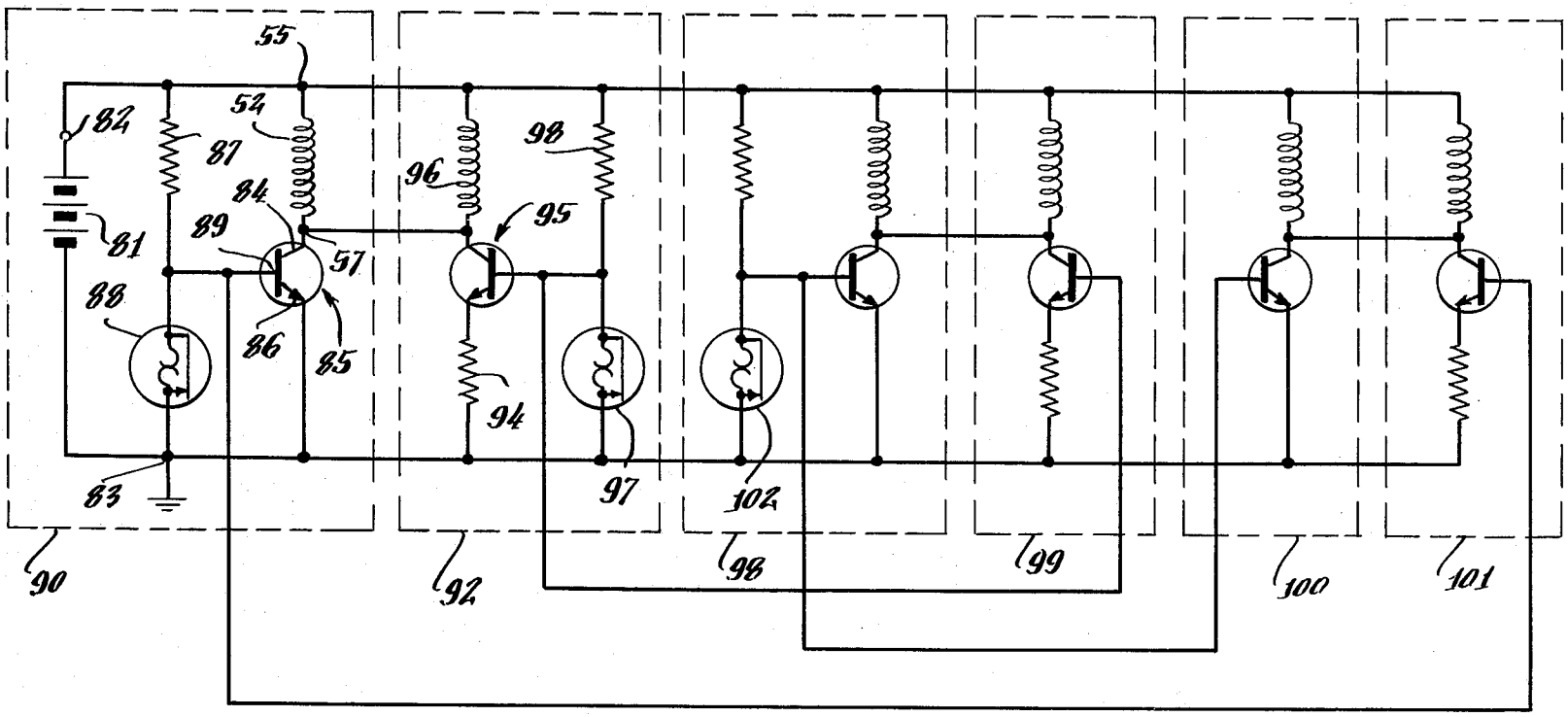
FIG. 7 is a schematic circuit diagram of an activating means capable of providing a plurality of random voltages which may be applied to energize the variable tension device.

Referring now to FIG. 7 which shows a schematic circuit diagram of a plurality of activating means for energizing the tension coils shown in FIG. 5, it will be noted that the circuit arrangement appearing within the broken lines 90 is the same as than shown in FIG. 6. By combining this basic configuration with a similar circuit arrangement (note the circuit within the broken line 92) which includes the use of an additional resistor 94 coupling the emitter electrode of transistor 95 to the reference ground 83. Resistance 94 will limit the current flow in the emitter-collector junction of transistor 95 when transistor 95 saturates thereby, limiting the current flow into tension coil 96 and the voltage appearing thereacross.

Thus, it can be seen that variations in the resistance value of resistors 87, 98, and 94, as well as, the temperature setting or trip value of the thermal switches 88 and 97 further adds to variations which increase the randomness of the tension applied to the filaments. The operation of the circuit arrangements appearing within the broken lines 98, 99, 100, and 101 operate in the same manner as described for the circuit arrangements appearing within the broken lines 90 and 92. It will also be noted that certain components, e.g. thermal switch 88 and 102 are utilized in common with more than one circuit arrangement.

Since transistors 85 and 95, as well as, all the other transistors are operated as switches with two stable states, off (no current flow in the emitter-collector junction) or saturated (maximum current in the emitter-collector junction) four current values or voltages may appear to activate tension coils 52 and 96. These conditions are as follows:

(a) Both transistors 85 and 95 can be off, therefore coils 52 and 96 are deenergized;

(b) Both transistors 85 and 95 can be on, therefore coils 85 and 95 will be at different voltage (current levels);

(c) Transistor 85 can be on with transistor 95 off, yielding another current (voltage) value; and (d) Transistor 95 can be on with transistor 85 off, yielding still another current (voltage) value.

Thus it is obvious to those skilled in the art that an infinite amount of current (voltage) values can be obtained with a minimum of circuit complexity. Each of the current arrangements may convert from one state to another in a rapid random manner. Coupling the disclosed circuit arrangement with the physical arrangement shown in FIG. 5 for the tension means further leads to the generation of randomly variable denier.

Figure 8:
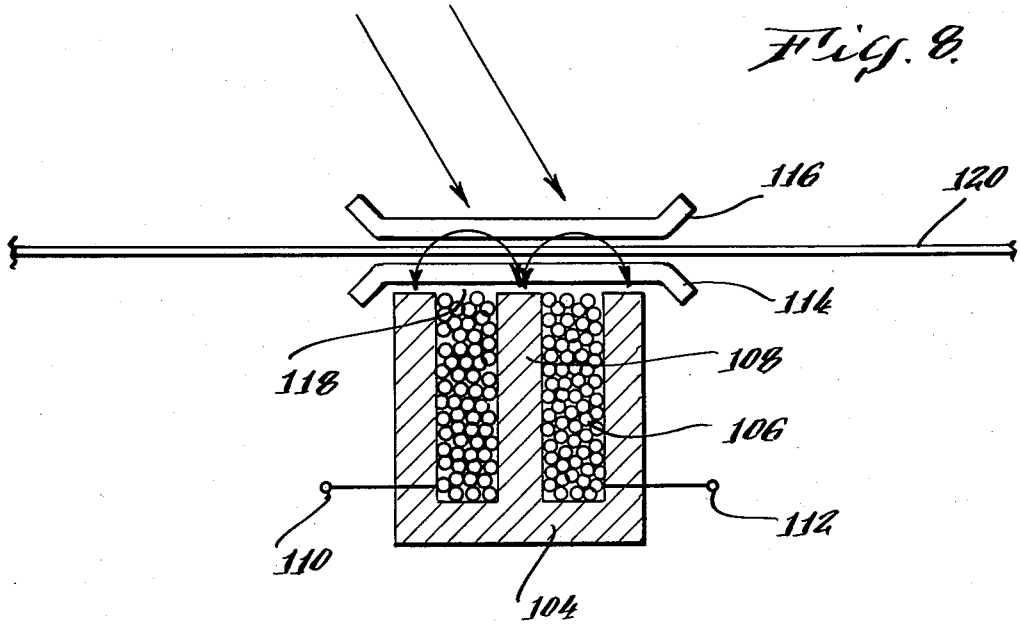
FIG. 8 is alternate embodiment of an electrically activated tension means for providing tension to the filament.

An alternate embodiment of a tension means 102 is shown in FIG. 8. The tension means 102 includes a solenoid having an E-shaped core 104 with a coil 106 wound around the central arm 108 of the core 104. The coil 106 is provided with two terminals 110 and 112 which may be connected in the circuit arrangements hereinbefore disclosed. A pair of tension plates 114 and 116 are provided which are in juxtaposition and disposed proximate the open end 118 of the E-shaped core. Tension plates 114 and 116 are adapted to receive a filament 120 therebetween. Tension plate 114 is preferably transparent to magnetic lines of flux (non-magnetic material) and tension plate 116 is fabricated from magnetic material so that the energization of coil 106 will cause plate 116 to be attracted or brought closer to plate 114 thus causing tension on filament 120. The voltage or current used to energize coil 106 being proportional to the amount of tension provided on filament 120.

Hereinbefore has been disclosed an electrically actuated tension means which is disposed between a feed foller and a draw roller and is adapted to apply variable tension on yarns and filaments for generating variable denier along its length. In addition, there has been disclosed an actuating means for randomly activating the tension means.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention, what is claimed is:

1. An apparatus for fabricating a filament exhibiting variations in denier along its length comprising:

(a) means to propel a running length of filament from a feed roller to a draw roller;

(b) electrically activated tension means disposed between said feed roller and said draw roller intermittently engaging said filament for providing variable tension thereon, said electrically activated tension means comprising solenoid means including a solenoid coupled to first and second contact plates in juxtaposition, said first and second contact plates adapted to slidably receive said filament therebetween said contact plates increasing the tension on said filament upon activation of said solenoid, and (c) actuating means coupled to said electrically activated means for random energization thereof.

2. An apparatus according to claim 1 wherein said electrically activated tension means is provided with a plurality of stable positions, each position providing a different amount of tension of said filament.

3. An apparatus according to claim 1 wherein said electrically activated tension means has an infinite number of stable positions, each position providing a different amount of tension of said filament.

4. An apparatus according to claim 1 wherein said electrically activated tension means is provided with a plurality of positions, each position providing a different amount of tension on said filament and means for rapidly changing from one position to another.

5. An apparatus for fabricating a filament exhibiting variations in denier along its length comprising:

(a) means to propel a running length of filament from a feed roller to a draw roller, (b) electrically activated tension means disposed between said feed roller and said draw roller intermittently engaging said filament for providing variable tension thereon, and (c) actuating means coupled to said electrically activated means for random energization thereof, said actuating means comprising:

(i) resistance means, (ii) switching means, said switching means and said resistance means being serially connected and adapted to be coupled across a source of DC voltage, and (iii) transistor means having emitter, base and collector electrodes, said collector electrode being connected to one end of said electrically activated tension means, the other end of said electrically activated tension means being coupled to said source of DC voltage, said emitter electrode being coupled to said reference ground, said base electrode being coupled to the common connection of said resistance means and said switching means.

6. An apparatus according to claim 5 wherein said switching means is a thermal switch.

7. An apparatus according to claim 5 further including an additional resistance means coupling the emitter electrode of said transistor to said reference ground.

8. An apparatus for fabricating a filament exhibiting variations in denier along its length comprising:

(a) means to propel a running length of filament from a feed roller to a draw roller;

(b) electrically activated tension means disposed between said feed roller and said draw roller intermittently engaging said filament for providing variable tension thereon, said electrically activated tension means comprising:

(1) solenoid means disposed in close proximity to said filament;

(2) a first contact plate disposed between said solenoid and said filament, said contact plate being transparent to magnetic lines of flux; and (3) a second contact plate disposed in juxtaposition with said first contact plate with said filament slidable therebetween, said contact plates increasing the tension on said filament upon activation of said solenoid; and (c) actuating means coupled to said electrically activated means for random energization thereof.

* * * * *